US012114774B1

(12) United States Patent
Jobst et al.

(10) Patent No.: US 12,114,774 B1
(45) Date of Patent: Oct. 15, 2024

(54) REMOVABLE BARRIER FOR A SHELF

(71) Applicant: Ingram Book Group LLC, LaVergne, TN (US)

(72) Inventors: Jonathan Stewart Jobst, LaVergne, TN (US); Michael Wayne Jeans, LaVergne, TN (US); Christopher Scott Willis, LaVergne, TN (US)

(73) Assignee: Ingram Book Group LLC, LaVergne, TN (US)

( * ) Notice: Subject to any disclaimer, the term of this patent is extended or adjusted under 35 U.S.C. 154(b) by 0 days.

(21) Appl. No.: 18/617,882

(22) Filed: Mar. 27, 2024

Related U.S. Application Data

(60) Provisional application No. 63/454,791, filed on Mar. 27, 2023.

(51) Int. Cl.
*A47B 96/00* (2006.01)

(52) U.S. Cl.
CPC ..... *A47B 96/00* (2013.01); *A47B 2220/0061* (2013.01)

(58) Field of Classification Search
CPC ..... B65G 1/02; B65G 2207/40; A47B 2220/0061; A47B 96/00; A47B 97/00
USPC ..... 211/183; 108/27
See application file for complete search history.

(56) References Cited

U.S. PATENT DOCUMENTS 4,981,225 A * 1/1991 Cole ..... B65G 1/02 211/208
5,170,829 A * 12/1992 Duncan ..... B65G 1/02 160/84.02
5,573,125 A * 11/1996 Denny ..... B65G 1/02 211/183
5,588,724 A * 12/1996 Emery ..... F25D 21/14 312/236
5,601,198 A 2/1997 Reed
5,791,501 A 8/1998 Baldwin, Jr.
5,984,121 A * 11/1999 Cole ..... B65G 1/02 211/183
6,585,122 B2 * 7/2003 Calleja ..... A47F 5/01 211/183

(Continued)

FOREIGN PATENT DOCUMENTS

JP 2002272550 A 9/2002
JP 2006158485 A 6/2006

(Continued)

*Primary Examiner* — Patrick D Hawn
(74) *Attorney, Agent, or Firm* — Patterson Intellectual Property Law, P.C.

(57) ABSTRACT

A strap anchor assembly is disclosed herein and configured to be coupled to a storage racking having a plurality of vertical supports with retaining holes defined therein. The strap anchor assembly may comprise at least one mounting bracket and a plurality of strap retainers. The at least one mounting bracket including a plurality of holes and one or more studs configured to be received by certain ones of the retaining holes of the storage racking. Each of the plurality of strap retainers configured to be received by one of the plurality of holes of the at least one mounting bracket. An end portion of a strap is configured to be received through one of the plurality of holes and wrapped at least partially around one of the plurality of strap retainers prior to the one of the plurality of strap retainers being received by the associated hole.

16 Claims, 8 Drawing Sheets

(56) References Cited

U.S. PATENT DOCUMENTS 6,598,270 B2 * 7/2003 Larsen ..... H05K 5/0204 248/68.1
6,609,621 B2 * 8/2003 Denny ..... B65G 1/02 211/183
6,722,512 B2 * 4/2004 Scully ..... A47F 5/13 211/183
7,014,053 B2 3/2006 Calleja
7,150,361 B2 * 12/2006 Calleja ..... A47F 7/0021 211/49.1
7,191,907 B2 * 3/2007 Conway ..... B65G 1/02 182/138
7,966,701 B2 6/2011 Shiue
8,094,035 B2 * 1/2012 Lane, Jr. ..... B65G 1/02 340/686.2
9,107,501 B2 * 8/2015 Nagy ..... A47B 96/00
9,146,001 B2 * 9/2015 Stifal ..... F16M 11/045
9,345,342 B1 * 5/2016 Nagy ..... B65G 1/02
10,421,407 B2 * 9/2019 Hughes ..... B60R 5/04
10,842,270 B2 11/2020 Clarke
11,297,967 B2 * 4/2022 Guyette ..... B65G 1/026
2004/0080105 A1 * 4/2004 Stevenson ..... B07C 7/02 271/278
2004/0182809 A1 * 9/2004 Calleja ..... A47F 5/132 211/183
2005/0103736 A1 * 5/2005 Calleja ..... A47B 47/021 211/187
2005/0263470 A1 * 12/2005 Horneland ..... A47F 5/01 211/183
2008/0083685 A1 * 4/2008 Chen ..... A47F 5/0018 211/134
2008/0093319 A1 4/2008 Stover et al.
2008/0272675 A1 11/2008 Denny
2009/0057637 A1 3/2009 Galla
2011/0068943 A1 3/2011 Lane, Jr.
2013/0276679 A1 10/2013 Kroeplien et al.
2015/0123062 A1 5/2015 Scullion
2022/0117394 A1 4/2022 Arnold et al.

FOREIGN PATENT DOCUMENTS

JP 3170539 U 9/2011
JP 2014018358 A 2/2014
JP 2014239847 A 12/2014

* cited by examiner

REMOVABLE BARRIER FOR A SHELF

CROSS-REFERENCES TO RELATED APPLICATIONS

This application claims benefit of U.S. Provisional Patent Application No. 63/454,791, filed Mar. 27, 2023, and which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

1. Field of the Invention

The present disclosure relates generally to safety systems for modular storage racks. More particularly, the present disclosure pertains to removable barriers configured to be coupled to modular storage racks.

2. Description of the Prior Art

Products frequently have the risk of falling off of storage racks, especially in warehouse-based fulfillment centers. This becomes an even larger risk in a "goods to person" environment where the storage racks may be moved around by a robot, for example in automated warehouse fulfillment systems or the like. Although numerous warehouse automation systems have been developed, there remains a need to ensure that inventory containers remain accessible while remaining on the mobile storage rack. The acceleration and deceleration of the robot and the storage racks can sometimes cause inventory to fall onto the floor. In the event that even a single inventory container falls from the mobile storage rack, the warehouse automation system can be delayed, and malfunctions can occur resulting in costly fulfillment delays.

Solutions to this problem generally focus on implementing net or strap retaining assemblies along shelves of the storage rack to help hold the product on the shelves. These current solutions often utilize elastic that becomes ineffective over time as the elastic loses its elasticity. Current solutions have no means of retightening the elastic to increase the life expectancy of the net or strap retaining assembly.

Current strapping technology for use on storage racks represents another challenge because the associated mounting bracket can become dislodged from the mounting holes of the storage rack. In extreme cases this can cause the elastic strap to strike bystanders and cause injury. Additionally, if the mounting bracket comes loose from its mounting holes, then the strap is no longer serving its purpose of retaining inventory on the shelves of the storage rack.

Accordingly, a need exists for improvements in safety systems for modular storage racks.

BRIEF SUMMARY

This Summary of the Disclosure is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect in accordance with the optional embodiments disclosed herein is a strap anchor assembly configured to be coupled to a storage racking having a plurality of vertical supports with retaining holes defined therein. The strap anchor assembly may include at least one mounting bracket having a front surface, a rear surface, and leading and trailing edges positioned opposite each other and defined between the front surface and the rear surface. The at least one mounting bracket may include one or more studs extending from the rear surface and positioned closer to the trailing edge than to the leading edge. The one or more studs may be configured to be received by certain ones of the retaining holes of a one of the plurality of vertical supports. The at least one mounting bracket may further include a plurality of holes defined between the front surface and the rear surface, the plurality of holes positioned closer to the leading edge than to the trailing edge and spaced apart in a direction parallel to the leading edge. The strap anchor assembly may further include a plurality of strap retainers, each of the plurality of strap retainers having a main portion and a leg extending perpendicularly from the main portion and configured to be received by one of the plurality of holes of the at least one mounting bracket. An end portion of a strap may be configured to be received through one of the plurality of holes of the at least one mounting bracket and be wrapped at least partially around one of the plurality of strap retainers prior to the one of the plurality of strap retainers being received by the associated hole of the plurality of holes.

In another aspect in accordance with the optional embodiments disclosed herein, the one or more studs of the at least one mounting bracket may include a plurality of studs.

In another aspect in accordance with the optional embodiments disclosed herein, the plurality of studs may be spaced apart in a direction parallel to the trailing edge.

In another aspect in accordance with the optional embodiments disclosed herein, the plurality of holes of the at least one mounting bracket may include three holes.

In another aspect in accordance with the optional embodiments disclosed herein, each of the plurality of holes may include a hole height that is greater than a hole width.

In another aspect in accordance with the optional embodiments disclosed herein, the strap anchor assembly may further include one or more straps configured to be coupled to the at least one mounting bracket via the plurality of strap retainers.

In another aspect in accordance with the optional embodiments disclosed herein, the one or more straps may include a first strap and a second strap, the first strap having a higher elasticity than the second strap.

In another aspect in accordance with the optional embodiments disclosed herein, the second strap may be associated with a lowermost hole of the plurality of holes of the at least one mounting bracket.

In another aspect in accordance with the optional embodiments disclosed herein, the end portion of the strap may be configured to be received through one of the plurality of holes of the at least one mounting bracket from the rear surface, wrap at least partially around one of the plurality of strap retainers, and be received back through the one of the plurality of holes from the front surface.

In another aspect in accordance with the optional embodiments disclosed herein, the at least one mounting bracket may include a first and second mounting bracket, each of the first and second mounting brackets being substantially similar in shape and size.

In another aspect in accordance with the optional embodiments disclosed herein, the strap anchor assembly may further include one or more straps configured to be coupled between the first and second mounting brackets.

In another aspect in accordance with the optional embodiments disclosed herein, the one or more straps may include a first strap and a second strap, the first strap having a higher elasticity than the second strap.

In another aspect in accordance with the optional embodiments disclosed herein, the second strap may be associated with a lowermost hole of the plurality of holes of the first and second mounting brackets.

In another aspect in accordance with the optional embodiments disclosed herein, tension of the one or more straps may be increased by pulling on an end portion of a respective one of the one or more straps.

In another aspect in accordance with the optional embodiments disclosed herein, the strap anchor assembly may further include one or more locking bars. Each of the one or more locking bars may be selectively couplable to a respective one of the plurality of strap retainers. When one of the one or more locking bars is selectively coupled to a respective one of the plurality of strap retainers received by one of the plurality of holes of the at least one mounting bracket, the one of the one or more locking bars may resist removal of the respective one of the plurality of strap retainers from the one of the plurality of holes.

In another aspect in accordance with the optional embodiments disclosed herein, the leg portion of each of the plurality of strap retainers may be split having a first leg and a second leg, the first and second legs separate by a gap, the gap configured to selectively receive a locking bar.

Numerous objects, features and advantages of the present invention will be readily apparent to those skilled in the art upon a review of the following description in conjunction with the accompanying drawings.

DETAILED DESCRIPTION

Figure 1:
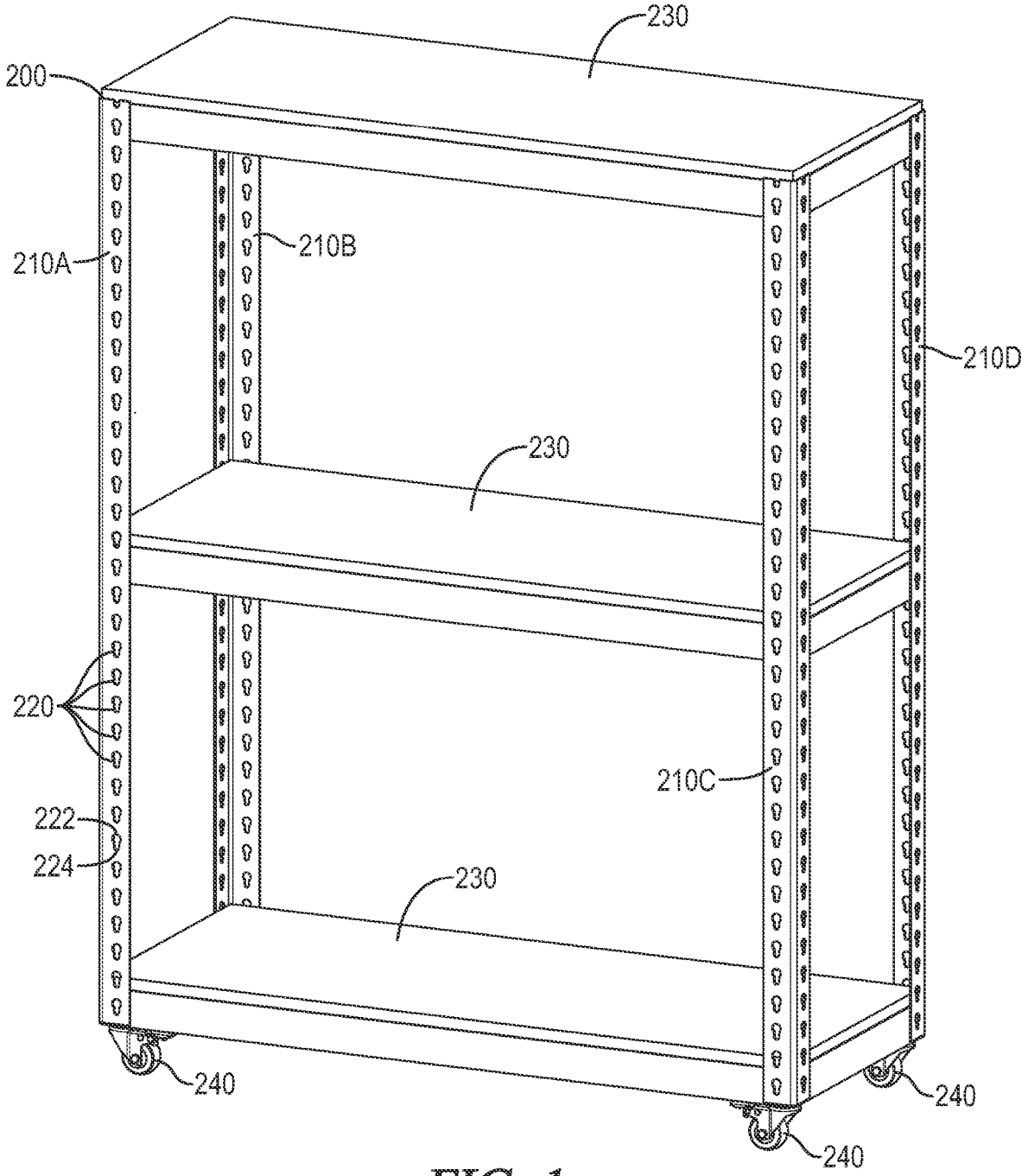
FIG. 1 is a perspective view of a storage racking.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components.

Figure 2:
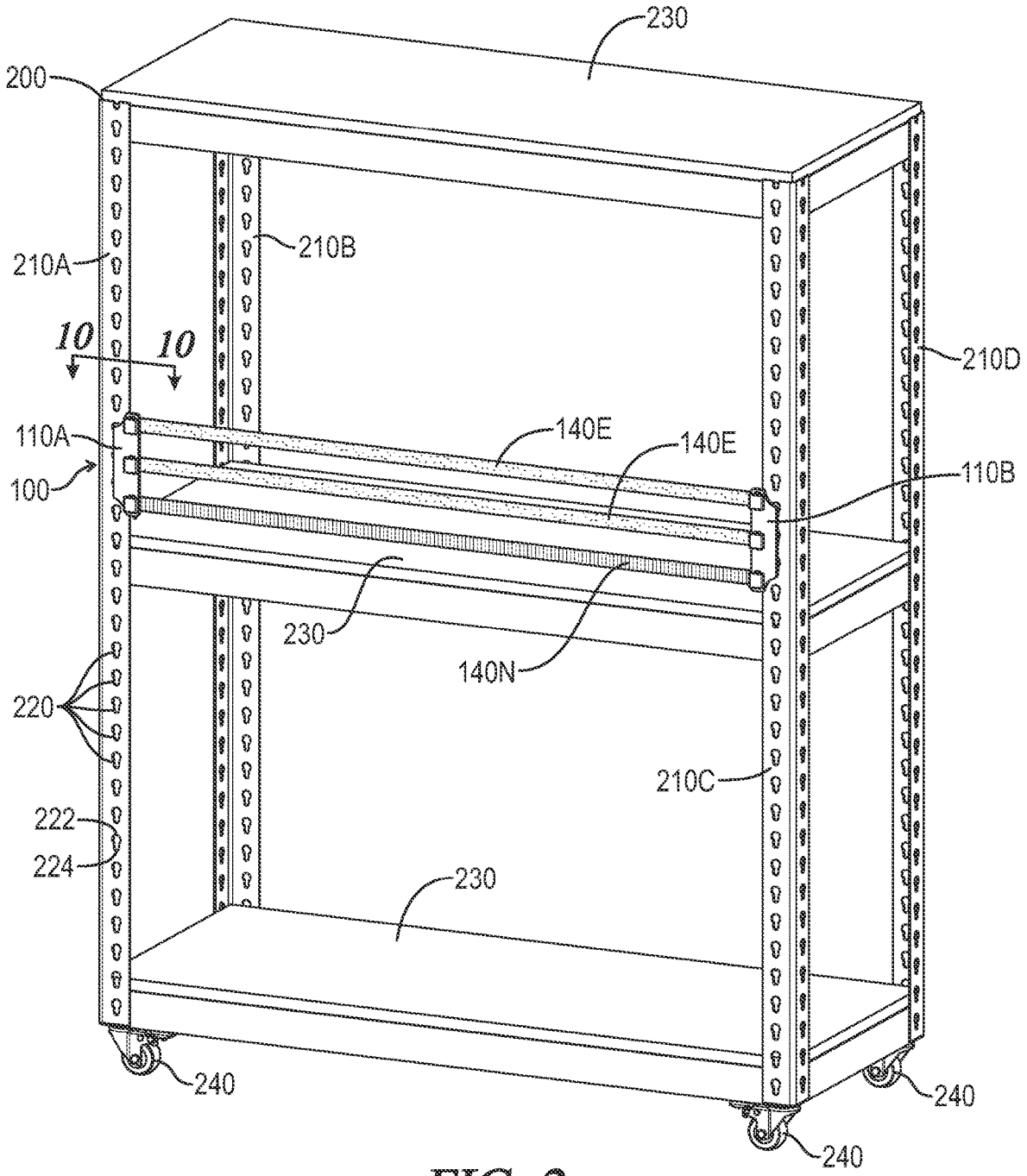
FIG. 2 is a perspective view of an embodiment of a strap anchor assembly as disclosed herein, coupled to the storage racking of FIG. 1.
Figure 3:
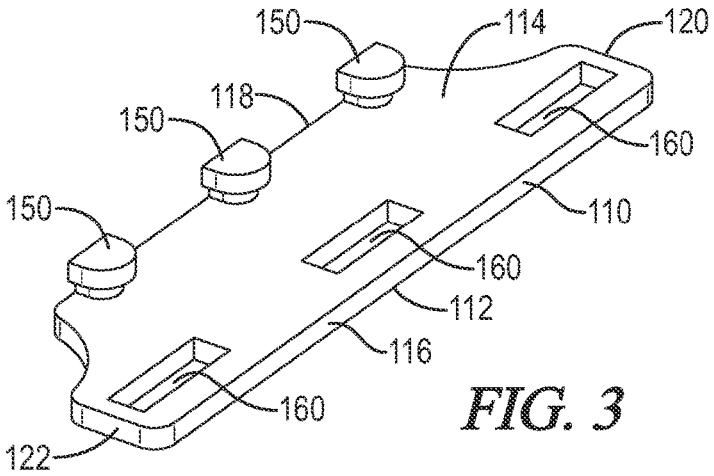
FIG. 3 is a perspective view of an embodiment of a mounting bracket as disclosed herein with respect to the strap anchor assembly of FIG. 2.
Figure 4:
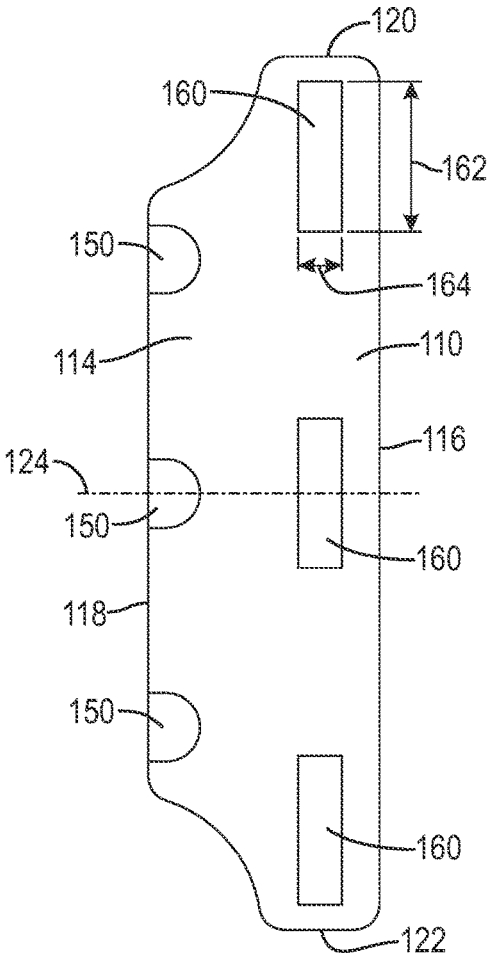
FIG. 4 is a rear view of the mounting bracket of FIG. 3.
Figure 5:
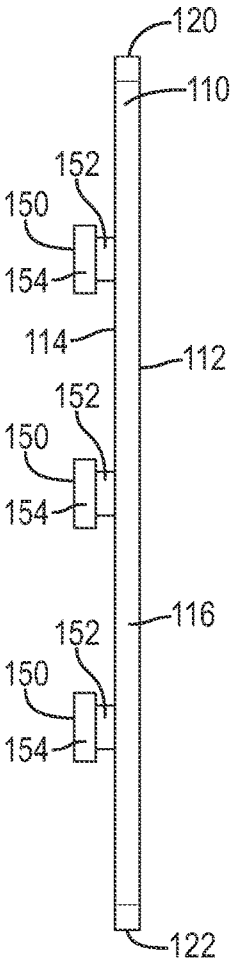
FIG. 5 is a right side view of the mounting bracket of FIG. 3.
Figure 6:
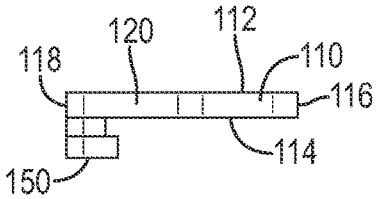
FIG. 6 is a top view of the mounting bracket of FIG. 3.

Referring to FIGS. 1 and 2, a strap anchor assembly is shown and generally designated by the number 100. The strap anchor assembly 100 may be configured to be coupled to and operable with a storage racking 200. The storage racking 200 may be configured to support inventory or other objects and be moved by a robotic device, human force, or the like. The storage racking 200 may include a plurality of vertical supports 210 (e.g., 210A, 210B, 210C, 210D). Each of the plurality of vertical supports 210 may include a plurality of retaining holes 220 sequentially defined along a height of the associated vertical support 210.

Each of the plurality of retaining holes 220 may be identical in shape and size. In certain optional embodiments, each of the plurality of retaining holes 220 may include a main portion 222 and a locking portion 224 extending from the main portion 222. The main portion 222 may have a larger diameter than the locking portion 224. The main portion 222 may be configured such that a stud may be freely inserted and removed from the retaining hole 220. The locking portion 224 may be configured to retain the stud such that it does not dislodge from the retaining hole 220. While an exemplary retaining hole 220 is described, it is within the spirit and scope of the present disclosure for the plurality of vertical supports 210 to include other types of retaining holes 220.

The storage racking 200 may further include a plurality of shelves 230 coupled between the plurality of vertical supports 210 and a plurality of wheels 240. Each of the plurality of wheels 240 may be coupled to a lower end of one of the plurality of vertical supports 210. Each shelf 230 may be coupled on a first side to two vertical supports 210A, 210B and at a second side to two other vertical supports 210C, 210D. Thus, each shelf 230 may be coupled to four vertical supports 210. While an exemplary embodiment of the storage racking 200 is shown in the figures, it is within the spirit and scope of the present disclosure for the storage racking 200 to include any number of vertical supports 210 and/or shelves 230.

Referring now to FIGS. 3-6, the strap anchor assembly 100 may include at least one mounting bracket 110. In certain optional embodiments, the strap anchor assembly 100 may include a first and second mounting bracket 110A, 110B selectively coupled together via one or more straps 140. The first and second mounting brackets 110A, 110B may be associated with and/or connected to, either directly or indirectly, one another. The first and second mounting brackets 110A, 110B may be mounted on separate vertical supports 210 at similar heights relative to a respective shelf 230.

Each mounting bracket 110 may include a front surface 112, a rear surface 114, a leading edge 116 a trailing edge 118, a top edge 120, and a bottom edge 122. The leading 116 and trailing edges 118 may be positioned opposite each other and defined between the front and rear surfaces 112, 114. The top edge 120 and the bottom edge 122 may be positioned opposite each other and defined between the front and rear surfaces 112, 114. The front surface 112 may be parallel to the rear surface 114. The leading edge 116 may be parallel to the trailing edge 118. The top edge 120 may be parallel to the bottom edge 122. The mounting bracket 110 may be symmetrical about a horizontal mid-division line 124 perpendicular to and bisecting both the leading and trailing edges 116, 118.

The mounting bracket 110 may further include one or more studs 150 extending from the rear surface 114. The one or more studs 150 may also be referred to herein as one or more hooks 150. In certain optional embodiments, the mounting bracket 110 may include a single stud 150. The single stud 150 may be located substantially near the horizontal mid-division line 124. In other optional embodiments, the mounting bracket 110 may include two studs 150 located on opposite sides of the horizontal mid-division line 124. Each of the one or more studs 150 may, for example, include a stem 152 extending from the rear surface 114 and an upper lip 154 positioned distal the rear surface 114. The stem 152 may have a smaller diameter than the upper lip 154. In certain optional embodiments (not shown), the upper lip 154 may, for example, extend from each of the one or more studs 150 in 360-degrees (e.g., a mushroom shape). In other optional embodiments, as illustrated in FIGS. 3-6, the upper lip 154 may, for example, extend from each of the one or more studs 150 in 180-degrees (e.g., a hook shape). In certain optional embodiments, the one or more studs 150 may be positioned closer to the trailing edge 118 than to the leading edge 116.

Each of the one or more studs 150 may be configured to be received by selected ones of the plurality of retaining holes 220 of the storage racking 200. More specifically, the upper lip 154 may have a smaller diameter than the main portion 222 of the retaining hole 220 and thus the upper lip 154 may be received by the main portion 222. The stud 150 may be translated such that the stem 152 is positioned in the locking portion 224 of the retaining hole 220. The stud 150 may be retained in the retaining hole 220 as the upper lip 154 of the stud 150 may have a larger diameter than the locking portion 224 and may not pass through the locking portion 224. To remove the stud 150 from the retaining hole 220, the stud 150 may be translated such that the stem 152 is positioned in the main portion 222 of the retaining hole 220. The upper lip 154 may then pass through the main portion 222 of the retaining hole 220, thus disengaging the stud 150 from the retaining hole 220.

The mounting bracket 110 may further include a plurality of holes 160 defined between the front surface 112 and the rear surface 114. In certain optional embodiments, the mounting bracket 110 the plurality of holes 160 may include three holes. The plurality of holes 160 may be positioned closer to the leading edge 116 than to the trailing edge 118. The plurality of holes 160 may further be spaced apart in a direction parallel to the leading edge 116. In certain optional embodiments, each of the plurality of holes 160 may be substantially rectangular in shape. Each of the plurality of holes 160 may have a height 162 (e.g., parallel to the leading edge 116) and a width 164 perpendicular to the height 162. The height 162 of each of the plurality of holes 160 may be greater than the width 164.

Referring back to FIG. 2, the strap anchor assembly 100 may include one or more straps 140. Each of the one or more straps 140 may be coupled between a pair of mounting brackets 110. Each of the mounting brackets 110 may be coupled to a different one of the plurality of vertical supports 210 of the storage racking 200 and at a common height above a respective one of the plurality of shelves 230 with the leading edges 116, respectively, facing each other.

Figure 15:
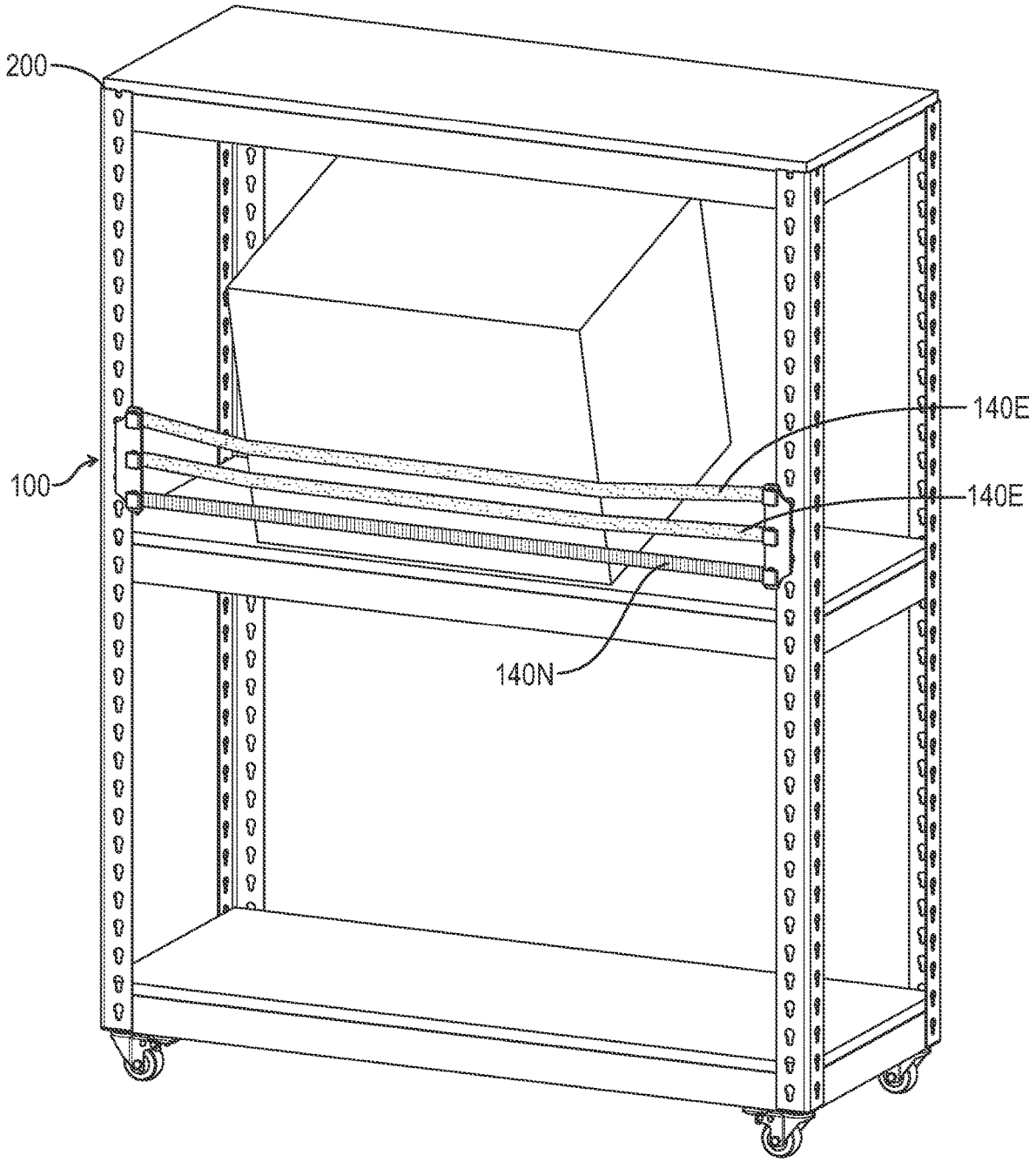
FIG. 15 is a perspective view of the strap anchor assembly of FIG. 2 coupled to the storage racking of FIG. 1 wherein inventory is being removed from a shelf.

In certain optional embodiments, at least a lowermost strap of the one or more straps 140 may be a non-elastic strap 140N and at least an uppermost strap of the one or more straps 140 may be an elastic strap 140E. As shown in FIG. 15, by making at least the lowermost strap a non-elastic strap 140N, inventory may be more rigidly and safely held in place on an associated shelf 230 of the storage racking 200 as a non-elastic strap 140N may be less likely to flex. Similarly, by making at least the uppermost strap an elastic strap 140E, inventory may be most easily removed from the shelf 230 of the storage racking 200 because an elastic strap 140E may flex outward and downward, allowing more room for removal of the inventory, but also works well in combination with the non-elastic lowermost strap 140N to maintain the inventory in place when removal of the inventory is not desired. In certain optional embodiments, the strap anchor assembly 100 may include three straps, wherein the lowermost strap is a non-elastic strap 140N, the middle strap is an elastic strap 140E, and the uppermost strap is an elastic strap 140E. A person of skill in the art would appreciate that other combinations of elastic and non-elastic straps 140E, 140N may be useful and desirable in some applications. For example, both a lowermost strap and an uppermost strap of the one or more straps 140 may both be elastic straps 140E. However, the lowermost elastic strap 140E may have less elasticity than the uppermost elastic strap 140E.

Figure 7:
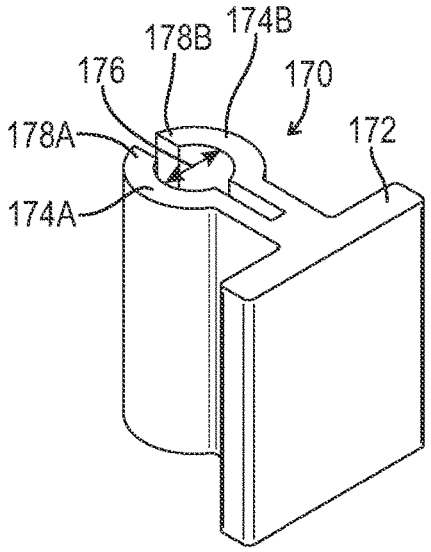
FIG. 7 is a perspective view of an embodiment of a strap retainer as disclosed herein with respect to the strap anchor assembly of FIG. 2.
Figure 8:
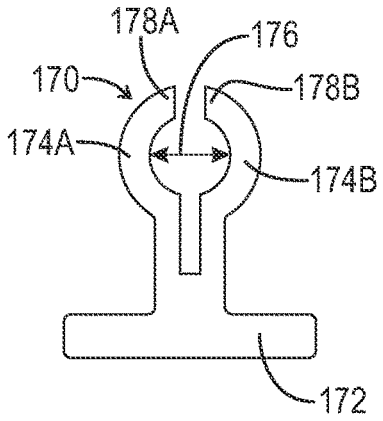
FIG. 8 is a top view of the strap retainer of FIG. 7.

Referring now to FIGS. 7 and 8, the strap anchor assembly 100 may include a plurality of strap retainers 170. Each of the plurality of strap retainers 170 may be associated with a respective one of the plurality of holes 1160. The plurality of strap retainers 170 may be configured to be received by the mounting bracket 110 for selectively coupling one or more straps 140 to the mounting bracket 110.

Each of the plurality of strap retainers 170 may include a main portion 172 and a leg 174 extending perpendicularly from the main portion 172. The main portion 172 may be wider than the width 164 of each of the plurality of holes 160 and may further be shorter (height-wise) than the height 162 of each of the plurality of holes 160. The leg 174 of each of the plurality of retainers 170 may be configured to be received by a respective one of the plurality of holes 160 of the mounting bracket 110.

The leg 174 of each of the plurality of retainers 170 may be a split leg having a first leg 174A and a second leg 174B, each extending perpendicularly from the main portion 172 and elongated parallel to the height of the main portion 172. A gap 176 may be defined between the first and second legs 174A, 174B. The first and second legs 174A, 174B may be operable to move toward each other such that gap 176 may be contracted. The first and second legs 174A, 174B may be biased away from each other such that after the gap 176 is contracted, the first and second legs 174A, 174B return to a resting position. A distance between exterior surfaces of the first and second legs 174A, 174B may generally be less than the width 164 of each of the plurality of holes 160. In certain optional embodiments, a distal end portion 178A, 178B of each of the first and second legs 174A, 174B, respectively, may be widened, for example, wider than the width 164 each of the plurality of holes 160 such that upon insertion of the first and second legs 174A, 174B into a respective one of the plurality of holes 160 beyond the distal end portion 178A, 178B, the associated one of the plurality of strap retainers 170 is maintained within the respective one of the plurality of holes 160.

Figure 11:
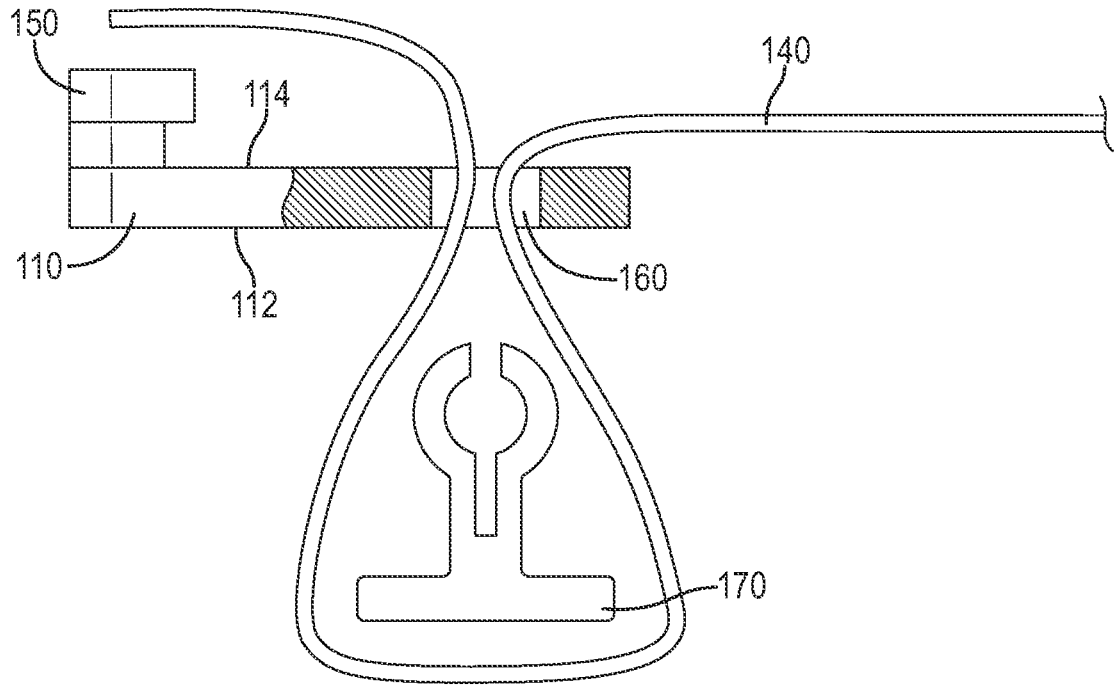
FIG. 11 is a partial schematic view of the strap anchor assembly of FIG. 2.
Figure 12:
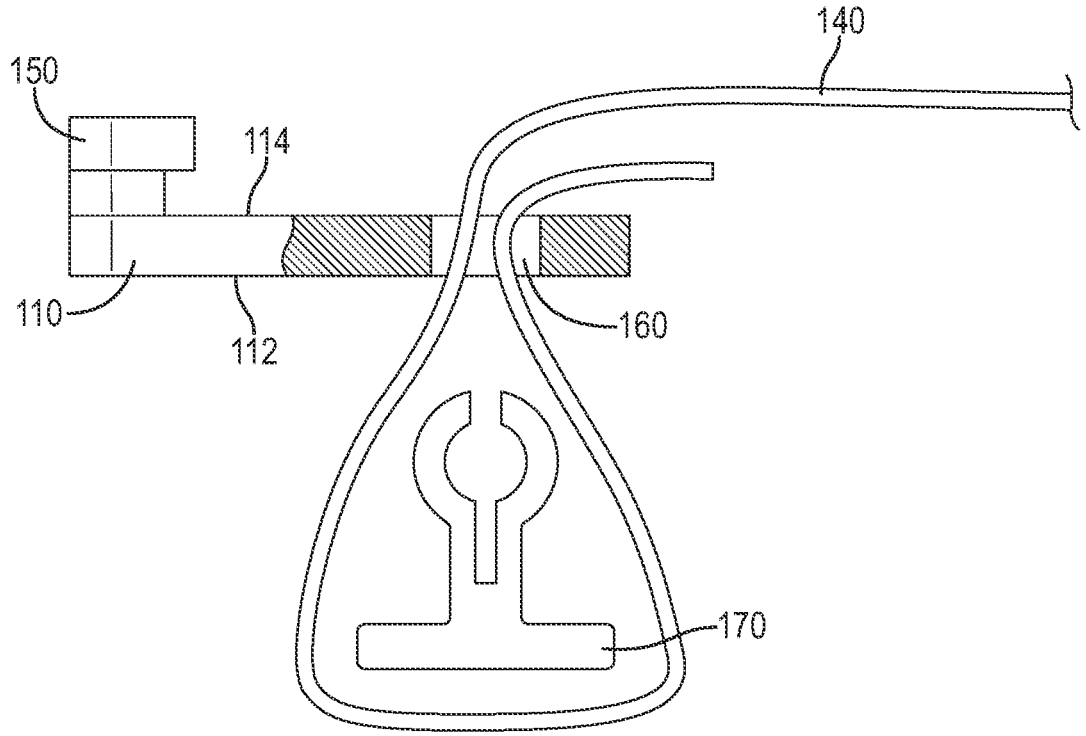
FIG. 12 is a partial schematic view of the strap anchor assembly of FIG. 2.

Referring now to FIGS. 10-13, in certain optional embodiments, each of the one or more straps 140 may be received through a respective one of the plurality of holes 160 via the rear surface 114 of the mounting bracket 110, wrapped at least partially around one of the plurality of strap retainers 170, and passed back through the associated one of the plurality of holes 160 prior to or simultaneously with insertion of the associated one of the plurality of strap retainers 170 into the associated one of the plurality of holes 160. In other optional embodiments, each of the one or more straps 140 may be received through a respective one of the plurality of holes 160 via the rear surface 114 of the mounting bracket 110 prior to insertion of the associated one of the plurality of strap retainers 170 into the associated one of the plurality of holes 160. Thus, the strap retainer 170 may resist movement of an associated strap 140 relative to the mounting bracket 110. FIGS. 11 and 12 show exemplary configurations of the one or more straps 140 relative to the mounting bracket 110 and plurality of strap retainers 170.

Figure 9:
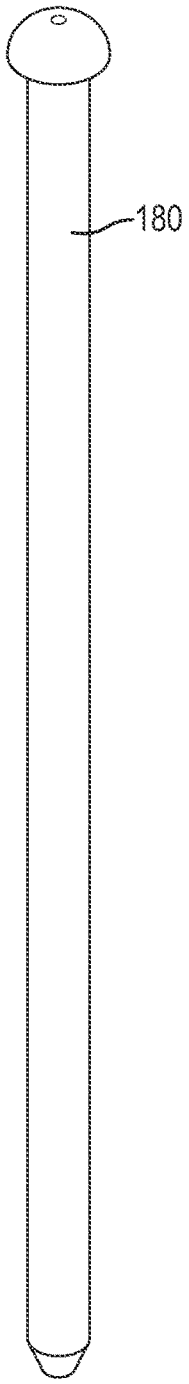
FIG. 9 is a lock bar of the strap anchor assembly of FIG. 2.
Figure 10:
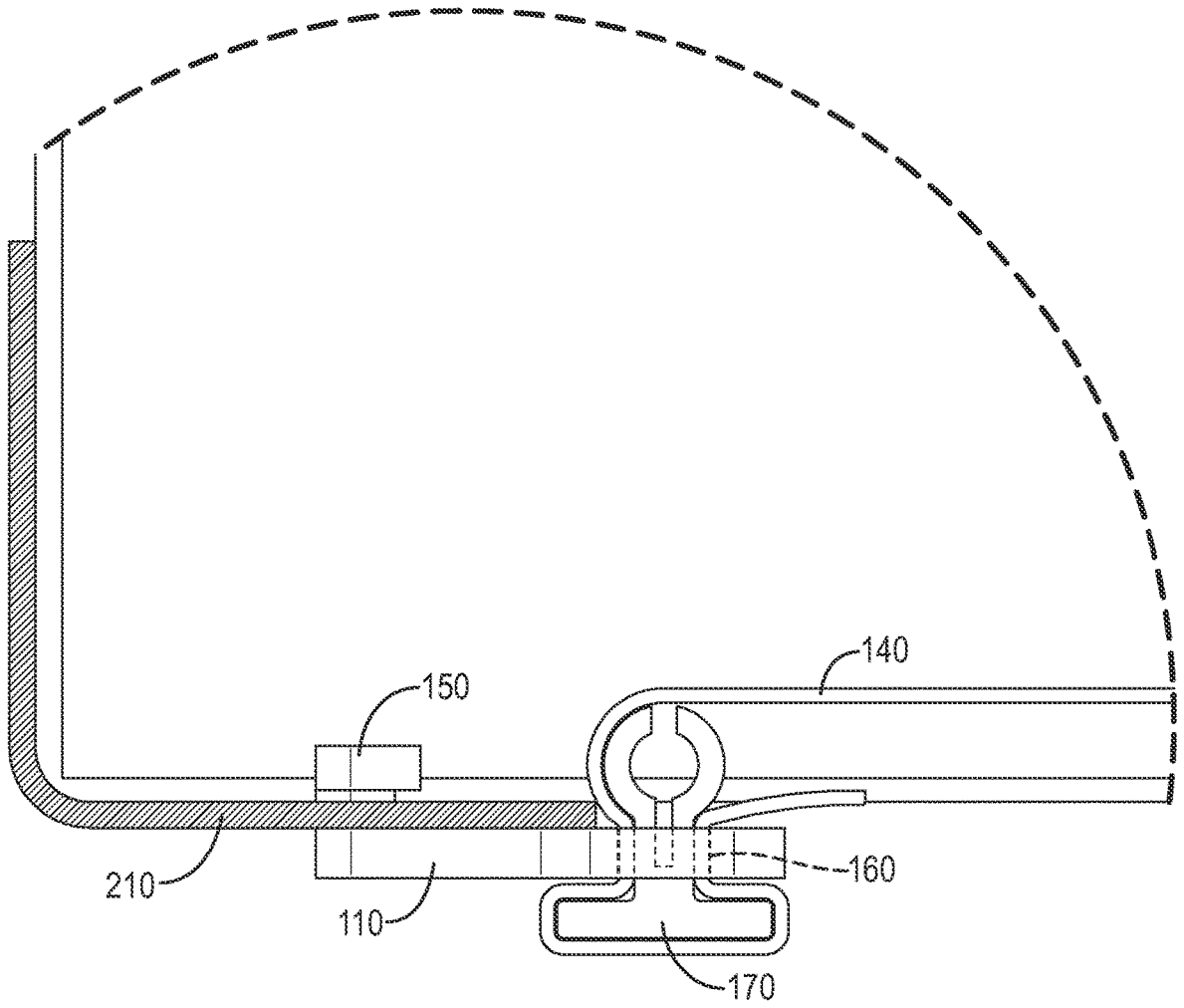
FIG. 10 is a section view of the strap anchor assembly of FIG. 2 taken along line 10-10.
Figure 13:
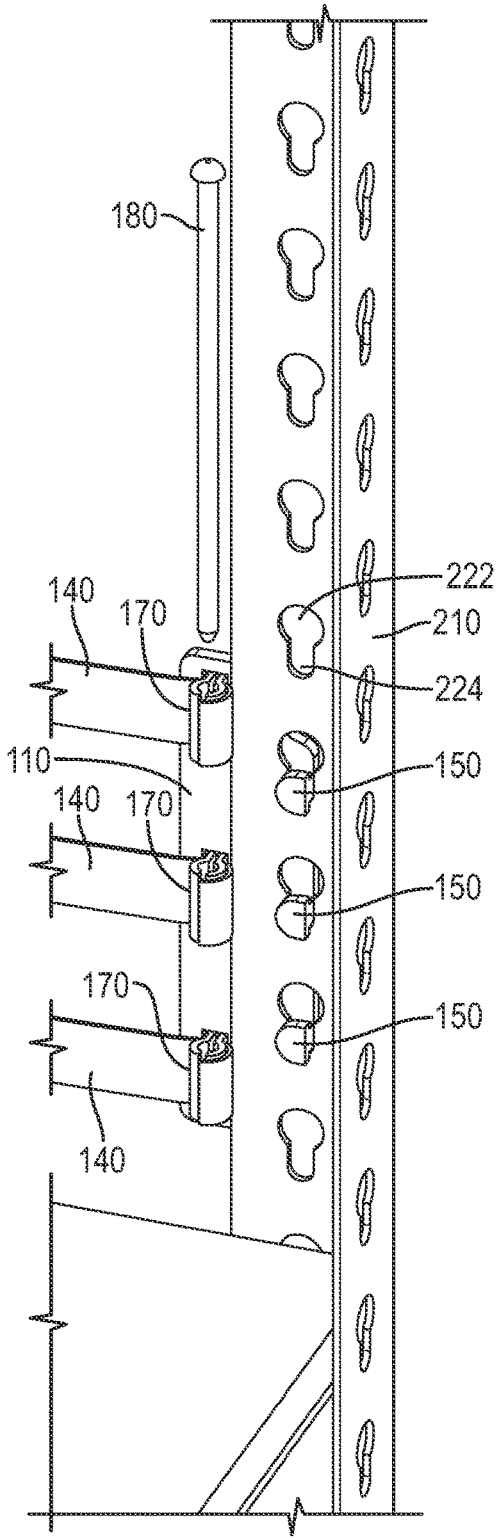
FIG. 13 is a partial perspective view of the strap anchor assembly of FIG. 2 coupled to the storage racking of FIG. 1 wherein the locking bar is not installed.
Figure 14:
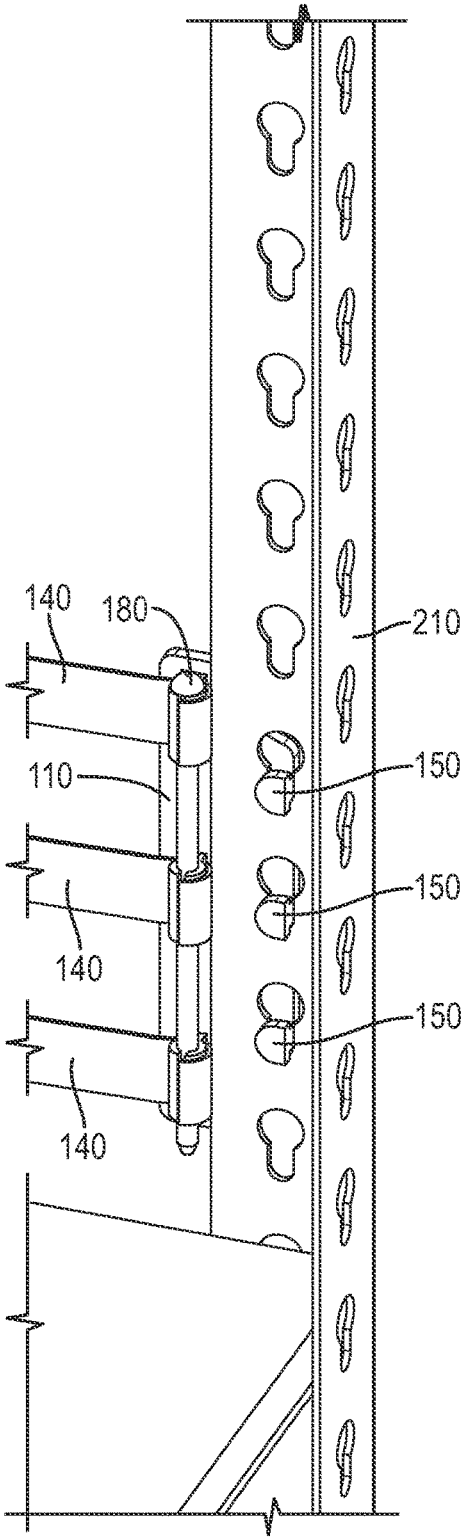
FIG. 14 is a partial perspective view of the strap anchor assembly of FIG. 2 coupled to the storage racking of FIG. 1 wherein the locking bar is installed.

Referring now to FIGS. 9, 13, and 14, after insertion of the plurality of strap retainers 170, a lock bar 180 may be installed between the first and second legs 174A, 174B of the plurality of strap retainers 170, for example, between the distal end portion 178A, 178B of each of the plurality of strap retainers 170. In certain optional embodiments, the lock bar 180 may be configured to be received by multiple ones of the plurality of retainers 170. In other optional embodiments, a plurality of lock bars 180 may be used, each having a length greater than the height 162 of each of the plurality of holes 160. The lock bar 180 may be configured to resist removal of an associated strap 140 and strap retainer 170 from a respective one of the plurality of holes 160.

The one or more straps 140 may be tightened and/or retightened by pulling an end portion of the strap 140 tight prior to its insertion with a respective one of the plurality of strap retainers 170 into the associated one of the plurality of holes 160. Thus, one advantage of the present disclosure may be that the one or more straps 140 may be retightened when the one or more straps 140 has loosened such that it no longer has a desirable tension. Another advantage may be that different straps 140 may be coupled to the mounting bracket 110 based on the desired application.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A strap anchor assembly configured to be coupled to a storage racking having a plurality of vertical supports with retaining holes defined therein, the strap anchor assembly comprising:

at least one mounting bracket having a front surface, a rear surface, and leading and trailing edges positioned opposite each other and defined between the front surface and the rear surface, the at least one mounting bracket including one or more studs extending from the rear surface and positioned closer to the trailing edge than to the leading edge, the one or more studs configured to be received by certain ones of the retaining holes of a one of the plurality of vertical supports, the at least one mounting bracket further including a plurality of holes defined between the front surface and the rear surface, the plurality of holes positioned closer to the leading edge than to the trailing edge and spaced apart in a direction parallel to the leading edge; and a plurality of strap retainers, each of the plurality of strap retainers having a main portion and a leg extending perpendicularly from the main portion and configured to be received by one of the plurality of holes of the at least one mounting bracket;

wherein an end portion of a strap is configured to be received through one of the plurality of holes of the at least one mounting bracket and be wrapped at least partially around one of the plurality of strap retainers prior to the one of the plurality of strap retainers being received by the associated hole of the plurality of holes.

2. The strap anchor assembly of claim 1, wherein the one or more studs of the at least one mounting bracket includes a plurality of studs.

3. The strap anchor assembly of claim 2, wherein the plurality of studs are spaced apart in a direction parallel to the trailing edge.

4. The strap anchor assembly of claim 1, wherein the plurality of holes of the at least one mounting bracket includes three holes.

5. The strap anchor assembly of claim 1, wherein each of the plurality of holes includes a hole height that is greater than a hole width.

6. The strap anchor assembly of claim 1, further comprising one or more straps configured to be coupled to the at least one mounting bracket via the plurality of strap retainers.

7. The strap anchor assembly of claim 6, wherein the one or more straps includes a first strap and a second strap, the first strap having a higher elasticity than the second strap.

8. The strap anchor assembly of claim 7, wherein the second strap is associated with a lowermost hole of the plurality of holes of the at least one mounting bracket.

9. The strap anchor assembly of claim 1, wherein the end portion of the strap is configured to be received through one of the plurality of holes of the at least one mounting bracket from the rear surface, wrap at least partially around one of the plurality of strap retainers, and be received back through the one of the plurality of holes from the front surface.

10. The strap anchor assembly of claim 1, wherein the at least one mounting bracket includes a first and second mounting bracket, each of the first and second mounting brackets being substantially similar in shape and size.

11. The strap anchor assembly of claim 10, further comprising one or more straps configured to be coupled between the first and second mounting brackets.

12. The strap anchor assembly of claim 11, wherein the one or more straps includes a first strap and a second strap, the first strap having a higher elasticity than the second strap.

13. The strap anchor assembly of claim 12, wherein the second strap is associated with a lowermost hole of the plurality of holes of the first and second mounting brackets.

14. The strap anchor assembly of claim 11, wherein tension of the one or more straps can be increased by pulling on an end portion of a respective one of the one or more straps.

15. The strap anchor assembly of claim 1, further comprising:

one or more locking bars, each of the one or more locking bars selectively couplable to a respective one of the plurality of strap retainers;

wherein when one of the one or more locking bars is selectively coupled to a respective one of the plurality of strap retainers received by one of the plurality of holes of the at least one mounting bracket, the one of the one or more locking bars resists removal of the respective one of the plurality of strap retainers from the one of the plurality of holes.

16. The strap anchor assembly of claim 15, wherein the leg portion of each of the plurality of strap retainers is split having a first leg and a second leg, the first and second legs separate by a gap, the gap configured to selectively receive a locking bar.

* * * * *